US005915443A

United States Patent [19]

Lindley, Jr.

[11] Patent Number: 5,915,443

[45] **Date of Patent: *Jun. 29, 1999**

[54] WINDOW SASH WITH SCREEN

[76] Inventor: Jack R. Lindley, Jr., 1911 Shirley Dr., Burlington, N.C. 27215

[ * ] Notice: Under 35 U.S.C. 154(b), the term of this patent shall be extended for 183 days.

[21] Appl. No.: 08/740,389

[22] Filed: Oct. 29, 1996

Related U.S. Application Data

[63] Continuation of application No. 08/440,096, May 12, 1995, abandoned, which is a continuation-in-part of application No. 08/407,334, Mar. 20, 1995, abandoned.

[51] Int. Cl.[6] ..... A47H 1/00

[52] U.S. Cl. ..... 160/100; 160/27; 160/99

[58] Field of Search ..... 160/99, 100, 27, 160/28

[56] References Cited

U.S. PATENT DOCUMENTS

| | | | |
|---|---|---|---|
| 268,125 | 11/1882 | Reynolds . | |
| 277,111 | 5/1883 | Carman . | |
| 1,223,934 | 4/1917 | Charlton . | |
| 1,349,438 | 8/1920 | Samplawski | 160/100 |
| 1,803,674 | 5/1931 | Nicholson | 160/99 |
| 1,971,451 | 8/1934 | Helfmann | 160/100 |
| 2,406,761 | 9/1946 | Golkowski | 160/100 |
| 2,462,520 | 2/1949 | Marbach | 160/100 |
| 3,155,146 | 11/1964 | Malouf et al. | 160/100 X |
| 3,173,474 | 3/1965 | Wootten | 160/100 X |
| 3,470,934 | 10/1969 | Agnew | 160/100 X |
| 3,522,834 | 8/1970 | Corcoran | 160/23 |
| 4,399,855 | 8/1983 | Volfson | 160/23 |
| 4,702,297 | 10/1987 | Van Klompenburg | 160/271 |
| 4,757,852 | 7/1988 | Jentof et al. | 160/23.1 |
| 4,846,241 | 7/1989 | Chomka et al. | 160/23.1 |
| 4,846,242 | 7/1989 | Baier | 460/32 |
| 4,846,248 | 7/1989 | Sonderby | 160/319 |
| 5,544,689 | 8/1996 | Wegner . | |

*Primary Examiner*—Blair M. Johnson

[57] ABSTRACT

The invention herein pertains to a screen for use with a conventional multiple-hung window. In the one embodiment, the window screen can be concealed in the bottom lateral member of the sash frame and unwound as the sash is raised thus providing an automatic window screen. When the sash is closed a spring-loaded axle causes the screen to tightly rewind within the sash cavity.

In the preferred form, an apron is provided below the window stool for housing a screen coil in which a free end is affixed to the bottom lateral member of the lower sash. A pivot bar attached to the lower sash allows the screen to evenly unroll even when the window sash yaws due to uneven pressure thereon or the like during opening and closing.

21 Claims, 6 Drawing Sheets

WINDOW SASH WITH SCREEN

This is a continuation of patent application Ser. No. 08/440,096 filed May 12, 1995, now abandoned which was a continuation-in-part of Ser. No. 08/407,334 filed Mar. 20 1995, now abandoned.

BACKGROUND OF THE INVENTION

1. Field of the Invention

The invention herein pertains to window screens and particularly to automatically operating window screens for multiple-hung windows as are used in houses and other buildings.

2. Description of the Prior Art and Objectives of the Invention

Double-hung windows with upper and lower sashes have been in use for many years in houses, offices and other buildings. Such double-hung windows are generally fabricated to allow both the top and bottom sashes to open and a fixed screen wire mesh is mounted either inside or outside the window to prevent insects and the like from entering the building when the sashes are opened. Conventional fixed screens accomplish their intended purpose of preventing insect entry but provide a subdued or dark illusion to the window. The same windows, without screens, are usually considered more attractive and provide a home with a "sharper" appearance. Thus, many homeowners remove the window screens during the winter and other times when window ventilation is not required. Reinstallation of the screens is therefore necessary in the Spring and poses an inconvenience. Oftentimes, screens which are removed and stored become damaged and must be repaired or replaced before being reinstalled. Conventional screens also require laborsome cleaning.

Thus, with the known disadvantages and problems of conventional window screens, the present invention was conceived and one of its objectives is to provide a window screen that is interiorly concealed when not in use, thus giving the closed window a clean, bright appearance.

It is still another objective of the present invention to provide a window screen that is easily utilized by simply opening the window sash.

It is another objective of the present invention to provide a window screen which is coiled within a double hung window component for unwinding from the sash containing the coiled screen.

It is yet another objective of the present invention to provide a fiberglass or other screen coil which is contained under tension and in one embodiment, in a window sash component for unwinding as the sash is opened and which automatically winds itself into a tight, compact, coiled, concealed configuration when the sash is closed.

It is also an objective of the invention to provide a second embodiment of the invention in which a coiled window screen is contained contiguous to a window stool for ease in retrofitting to existing windows.

It is still a further objective of the invention to provide another embodiment of the invention in which a coiled window screen is contained within a window sill member.

Various other objectives, structures and advantages of the invention will become apparent to those skilled in the art as a more detailed description is set forth below.

SUMMARY OF THE INVENTION

A screen for a double-hung window sash in one embodiment of the invention is contained in concealed, coiled fashion on a tensioned cylinder within a lateral member of a sash. The "free" end of the coiled screen is attached to the window frame sill whereby opening the sash will cause the coiled screen to unwind and to thus prevent entry of insects or the like through the open window. A rotatable flap is also fixed to the sash along its width so that any gap between the upper and lower sashes will be closed as the sash is opened. The unwound window screen as provided will automatically wind onto the cylindrical member as the window is closed so the screen will return to its compact, coiled storage posture. Other embodiments of the invention feature a coiled or rolled screen in a window stool or sill for easy retrofitting of existing windows and a pivot bar attached to the sash to accommodate screen movement.

DESCRIPTION OF THE PREFERRED EMBODIMENT

The preferred form of the invention is illustrated in FIGS. 7, 7A, 7B, and 7C. As shown therein, a double-hung window includes a sill and stool whereby the rear of the stool containing a coiled screen provides an opening for allowing the screen to pass therethrough. The free end of the screen is attached to the inside surface of the lateral member of the lower sash and is attached to a pivot bar thereon. The pivot bar is formed from a rigid material such a metal strip and will allow the screen to adjust to uneven motion of the window as it is raised or lowered to prevent jamming. The spring-loaded screen coil contained beneath the stool is enclosed by an apron type molding. An L-shaped bracket member prevents rain or moisture from entering beneath the stool into the cavity formed by the apron. A U-shaped screen guide is hingedly affixed at each side of the lower sash to prevent entry by insects or the like along the edges of the screen when the lower sash is opened.

DETAILED DESCRIPTION OF THE DRAWINGS AND OPERATION OF THE INVENTION

Figure 1:
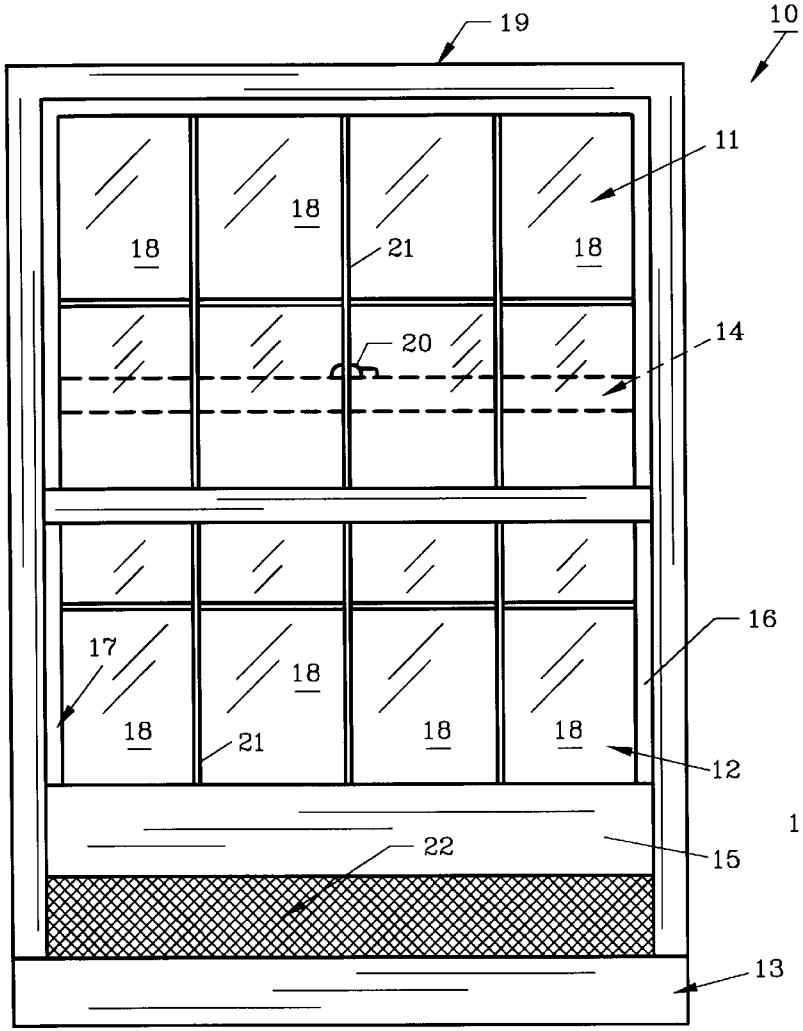
FIG. 1 shows an outside frontal view of a double-hung window incorporating the invention herein.
Figure 4:
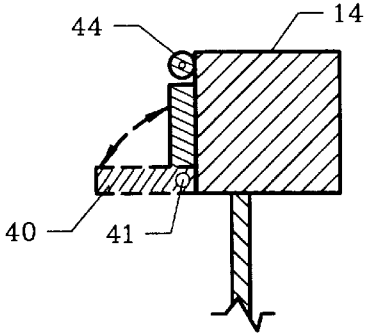
FIG. 4 depicts an enlarged cross-sectional view of the pivotable flap attached to the top lateral member of the lower sash.

Turning now to the drawings, FIG. 1 demonstrates window 10, which is of the double-hung type having top sash 11 and bottom sash 12. As seen, bottom sash 12 has been raised from sill 13 a few inches for ventilation purposes. Bottom sash 12 includes top lateral member 14, bottom lateral member 15, right jamb member 16 and left jamb member 17. Top lateral member 14, bottom lateral member 15, right jamb member 16 and left jamb member 17 are connected to form a rectangular sash which surrounds a plurality of glass panels 18. As would be understood, top sash 11 may likewise be openable in outer frame 19 and also includes glass panels 18. Top sash 11 and bottom sash 12 are slidably contained within outer window frame 19 which may include suitable moldings or the like for insertion into a preformed rough wall opening during construction, as is conventional in the trade.

Mullions 21 separate glass panels 18 but could be of the "artificial" variety if a large single pane of glass is used for each sash. As further shown in FIG. 1, screen 22 prevents insects, debris or the like from entering the opening formed when bottom sash 12 is raised from sill 13. Screen 22 is affixed to sill 13 by screws 23 or the like as shown in FIG. 2 from a side view.

Figure 2:
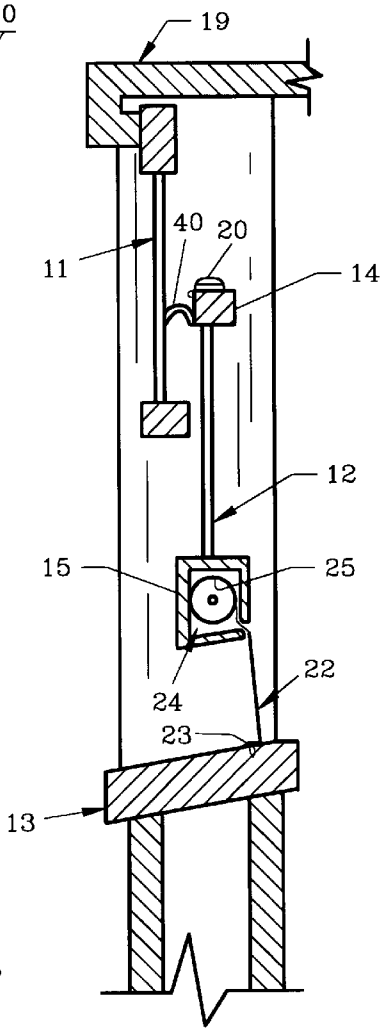
FIG. 2 illustrates a schematic side view of the double-hung window as shown in FIG. 1 with the coiled screen exposed.
Figure 6:
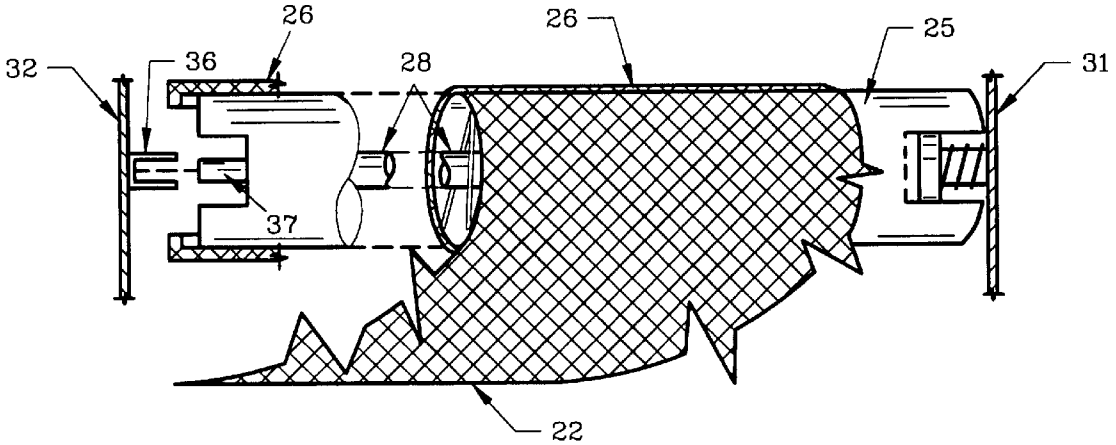
FIG. 6 presents the tensioned core as seen in FIG. 5 showing the mounting thereof.

In FIG. 2, bottom window sash 12 is seen, along with top sash 11 in schematic fashion. Bottom sash 12 includes lateral member 15 which has been formed with a longitudinal cavity 24. Positioned within cavity 24 is a substantially hollow, tensioned cylindrically-shaped core 25 as also seen in FIG. 6. Tensioned core 25 may, for example, be a plastic tube which serves to support screen coil 26 wrapped therearound. Several windings of screen 22 form screen coil 26 as would be necessary, depending on the diameter of tensioned core 25 to provide an ample length when fully opening or raising bottom sash 12 from sill 13. As screen 22 unrolls from screen coil 26 during the raising of bottom sash 12 as seen in FIG. 2, coil spring 27 contracts or tightens around core axle 28. Thus, during closing of bottom window sash 12 against window sill 13, tensioned core 25 rotates to urge screen 22 therearound in compact fashion within longitudinal cavity 24.

Figure 3:
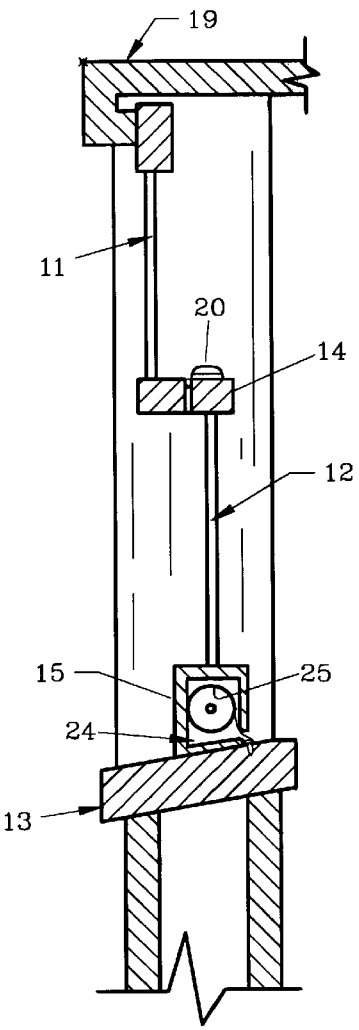
FIG. 3 demonstrates the double-hung window of FIG. 2 with the sashes closed.
Figure 5:
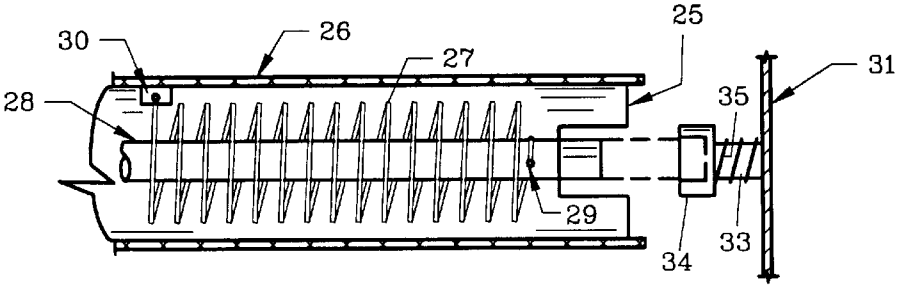
FIG. 5 pictures a schematic cut-away view of tensioned core which supports the coiled screen.

In FIG. 5, coil spring 27 is attached at end 29 to core axle 28 and coil spring end 30 is attached to the inside of tensioned core 25. Also, as seen in FIGS. 5 and 6, bottom lateral member 15 includes end plates 31, 32. For installation or repair purposes, the front or bottom of lateral member 15 could be joined by those skilled in the art for easy removal as desired. End plates 31, 32 as shown in FIGS. 5 and 6 may be, for example, formed from a thin metal and are not visible in FIGS. 2 and 3 for purposes of clarity. End plate 31 (FIG. 5) is attached to mounting stud 33 which is attached to slidable cap 34. Cap 34 is spring-loaded by small coil spring 35 for convenience when positioning tensioned core 25 within bottom lateral member 15 during installation or repair. As would be understood, the end of core axle 28 is slidably received within cap 34 and cap 34 can then be easily urged from left to right as shown in FIG. 5 toward end plate 31. When this occurs, mounting bracket 36 as shown in FIG. 6 is then easily engagable with flat axle end 37 which is integral with core axle 28. Mounting bracket 36 prevents the rotation of core axle 28 while tensioned core 25 rotates therearound. Various other means may be available for rigidly affixing core axle 28 in bottom lateral member 16 as may be developed by those skilled in the art.

As would be understood from the embodiment of the invention as seen in FIGS. 1–6, screen 22 automatically fills any openings formed in window frame 19 as bottom sash 12 is raised. Likewise, as bottom sash 12 is lowered towards sill 13, coil spring 27 causes tensioned core 25 to rotate and rewind screen 22 therearound.

Bottom sash 12 may be opened to any of a variety of selected positions along top sash 11 within window frame 19, and pivotable flap 40 is available to prevent insect entry between bottom sash 12 and top sash 11 as shown in FIG. 2. Pivotable flap 40 may consist of a longitudinally extending nylon brush, vinyl strip, or the like which is pivotably joined by axle pin 41 a seen in FIG. 4 to top lateral member 14. As would be understood, flap 40 is of such a weight to be affected by gravity and thus when bottom sash 12 is lifted, flap 40 falls in counter-clockwise rotation into contact with top sash 11 as shown in FIG. 2. Also, standard seal 44 provides insulation between sashes 11 and 12 when said sashes are closed.

Figure 7B:
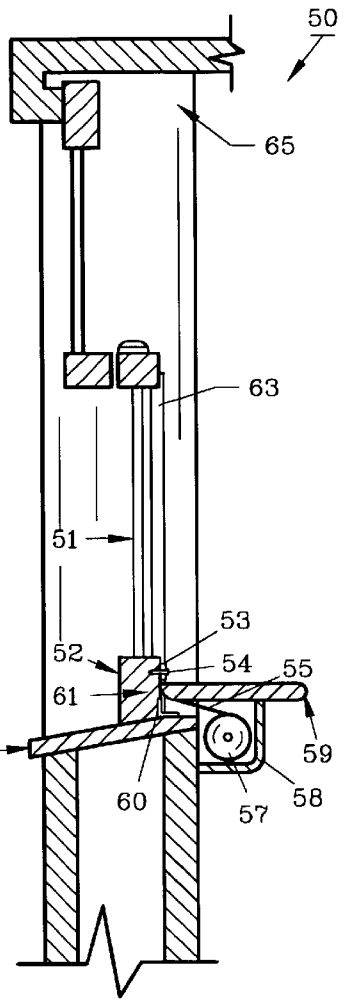
FIG. 7B shows the window of FIG. 7A closed.
Figure 7A:
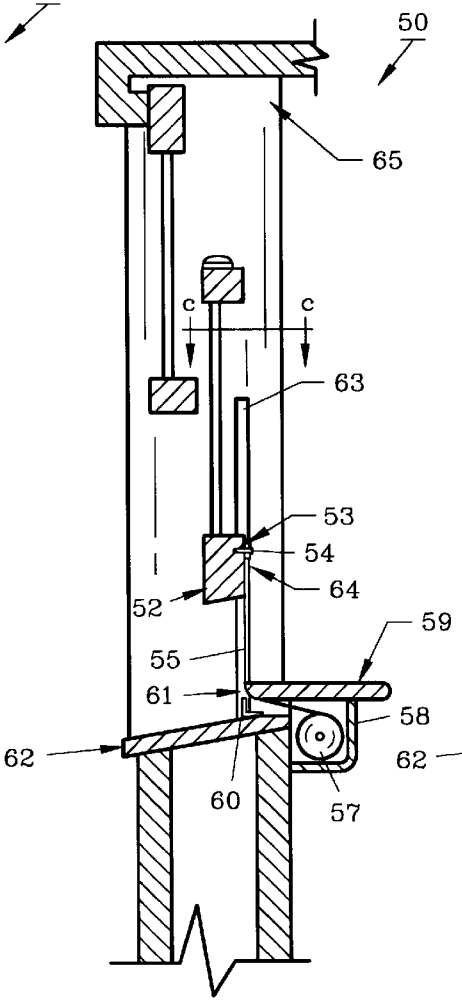
FIG. 7A illustrates a side schematic view of the window of FIG. 7 which has been fitted with a coiled screen concealed below the stool in an apron, with the lower sash raised.
Figure 7:
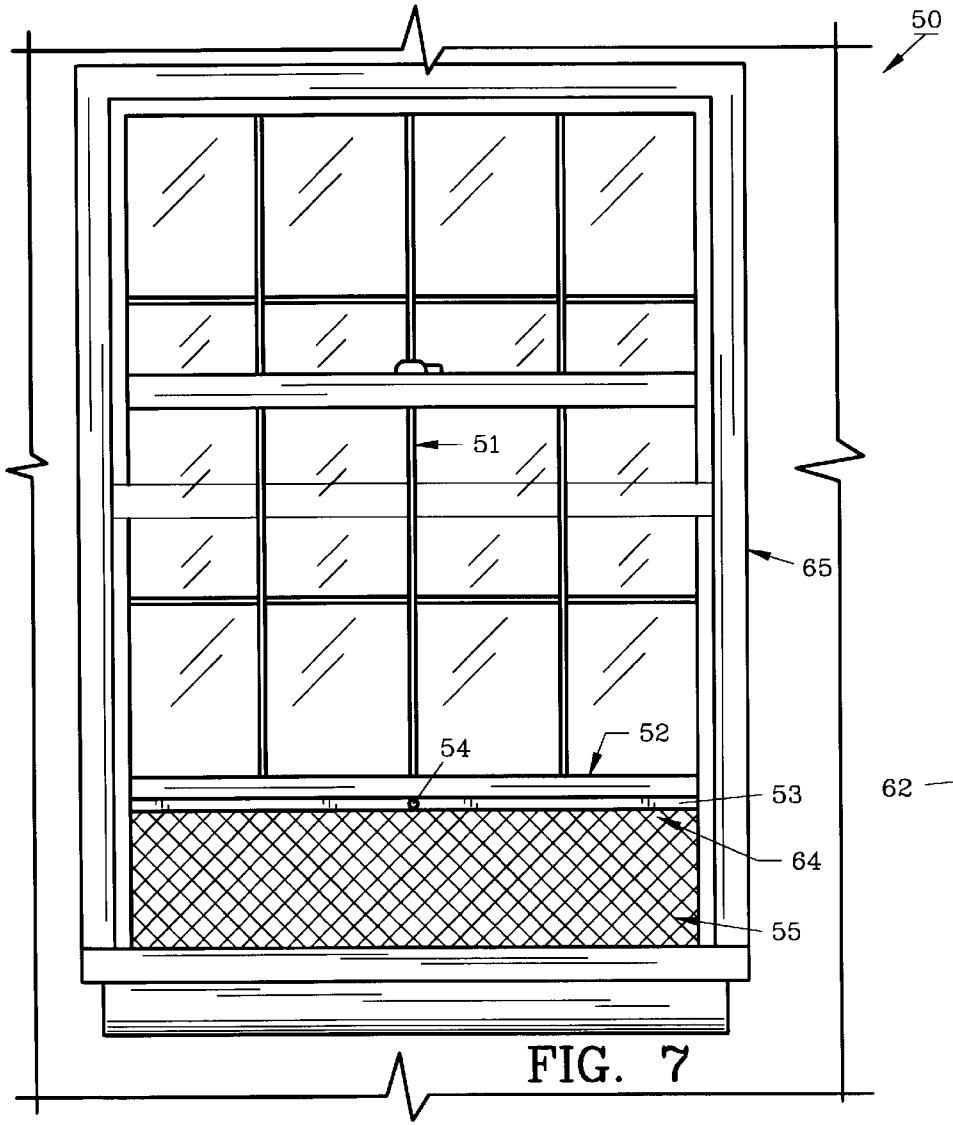
FIG. 7 shows another embodiment of the invention for a double-hung window.

The preferred embodiment of the invention is shown in FIGS. 7, 7A, 7B and 7C in which double-hung window 50 is seen in FIG. 7 with bottom sash 51 partially raised. Attached to the front surface of bottom lateral member 52 at lower sash 51 is pivot bar 53 also shown in FIGS. 7A and 7B. Pivot bar 53 is formed from aluminum or the like for attachment to free end 64 of screen 55 and is swingable around threaded member 54 which may be a wood screw, nail, bolt or the like which passes through an opening therein for affixing pivot bar 53 at the approximate middle of lower lateral member 52 having a length L as seen in FIG. 7. The rotating action of pivot bar 53 allows screen 55 which may be formed from aluminum, fiberglass, or a polymeric material to readily unwind from screen coil 57 contained within apron molding 58 attached to stool 59. Screen coil 57 has a spring operated core as described for screen coil 26 in FIGS. 5 and 6 above, and as shown in FIG. 7A, a conventional double-hung window featured in FIGS. 8A and 8B has been modified whereby a traditional stool has been formed with passageway 61 at the rear thereof to allow screen 55 to exit therefrom as sash 51 is raised. L-shaped bracket 60 helps prevent rain and moisture from entering passageway 61. As would be understood, as sash 51 is lowered into contact with sill 62, screen 55 rewinds itself into compact screen coil 57 as earlier explained. Sash 51, as with most double-hung window sashes, cannot be raised or lowered in a perfectly smooth, even fashion, but will tend to yaw slightly in movement. Pivot bar 53 helps to compensate for this uneven movement and prevents screen 55 from binding during raising or lowering of sash 51, since pivot bar 53 will rotate around threaded member 54.

Figure 7C:
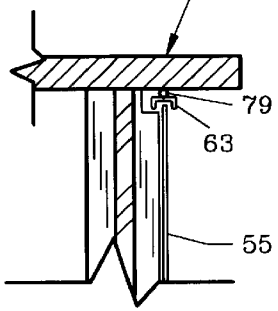
FIG. 7C pictures a sectional view along lines C—C of FIG. 7A.
Figure 8B:
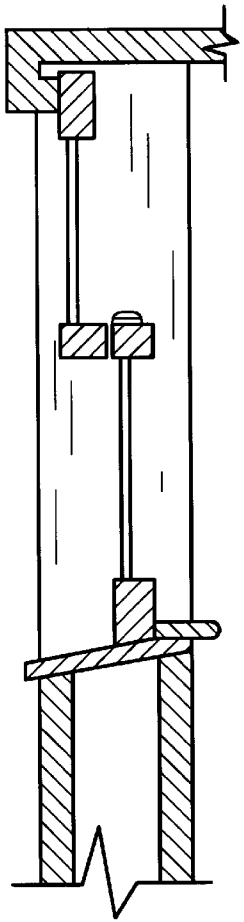
FIGS. 8A and 8B demonstrate side schematic representations of a conventional double-hung window and stool with the lower sash in both open and closed postures.
Figure 8A:
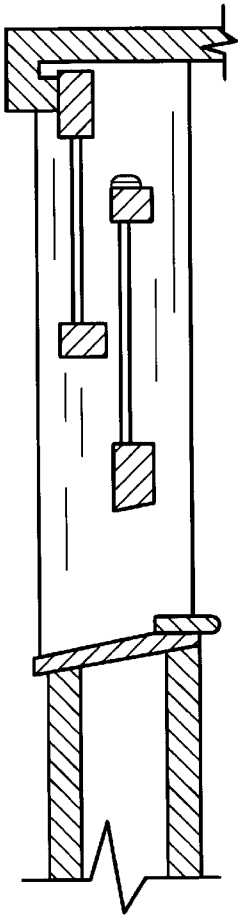
FIG. 8A PRIOR ART

As further shown in FIG. 7A, double-hung window 50 may be of the type which will rotate inwardly for cleaning purposes. For use with such windows, U-shaped channel 63 is attached to window frame 65 and acts as a guide for the edge of screen 55, and as shown in FIG. 7C is hingedly affixed by pin 79 to window frame 65 to rotate as window 50 is tilted inwardly for cleaning or maintenance purposes. Such U-shaped channels would normally be placed along opposite side edges of screen 55 and may be formed of a suitable flexible plastic.

Figure 9C:
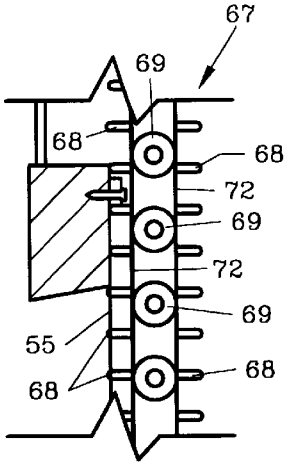
FIG. 9C depicts a fragment of the movable screen edge tractor drive of FIGS. 9A and 9B in enlarged fashion.
Figure 9B:
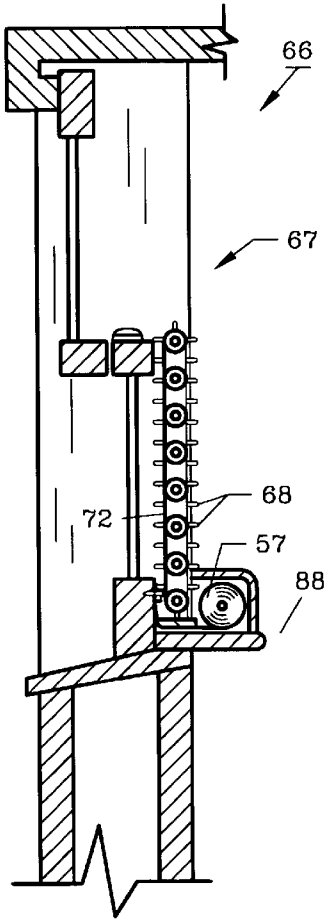
FIG. 9B demonstrates the window of FIG. 9A, but with the lower sash closed.
Figure 9A:
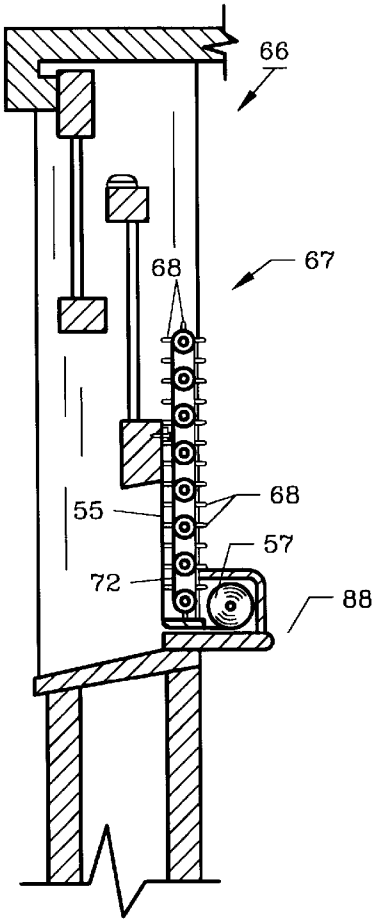
FIG. 9A depicts another configuration of the embodiment of an open window, with the coiled screen concealed above the stool and a screen edge tractor drive.

In another embodiment, as seen in FIGS. 9A and 9B, double-hung window 66 includes screen coil 57 positioned atop stool 88 which may be easier to install when retrofitting existing windows in homes or office buildings. Tractor drive 67, shown enlarged in FIG. 9C includes teeth 68 which slightly engage the openings in screen 55 to help screen 55 unwind or wind in a smooth, even fashion and may be used in place of U-shaped guides 63. While only one tractor drive 67 is seen, a duplicate drive 67 could be placed at the other side of window 66 as needed, for example on very wide windows. Tractor drive 67 includes rollers 69 which support belt 72 having short, cylindrically shaped teeth 68 attached therealong. Tractor drive 67 may not be necessary in some expensive, precision manufactured windows as are sold in the trade, but can be used as desired and forms a seal along the sides of the window.

Figure 10A:
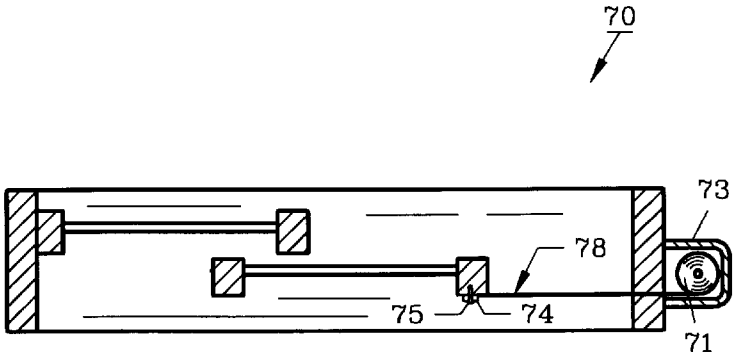
FIG. 10A presents a top schematic view of the window of FIG. 10 shown opened.
Figure 10B:
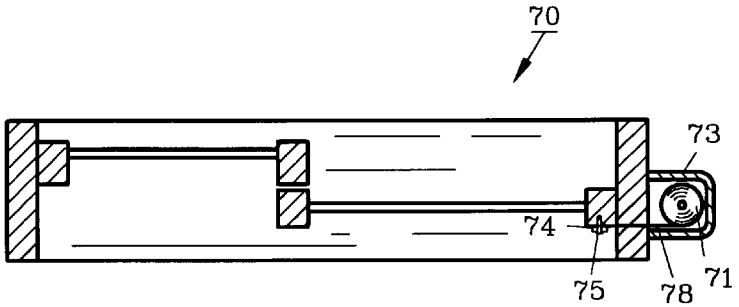
FIG. 10B demonstrates the window of FIG. 10 in closed configuration.
Figure 10:
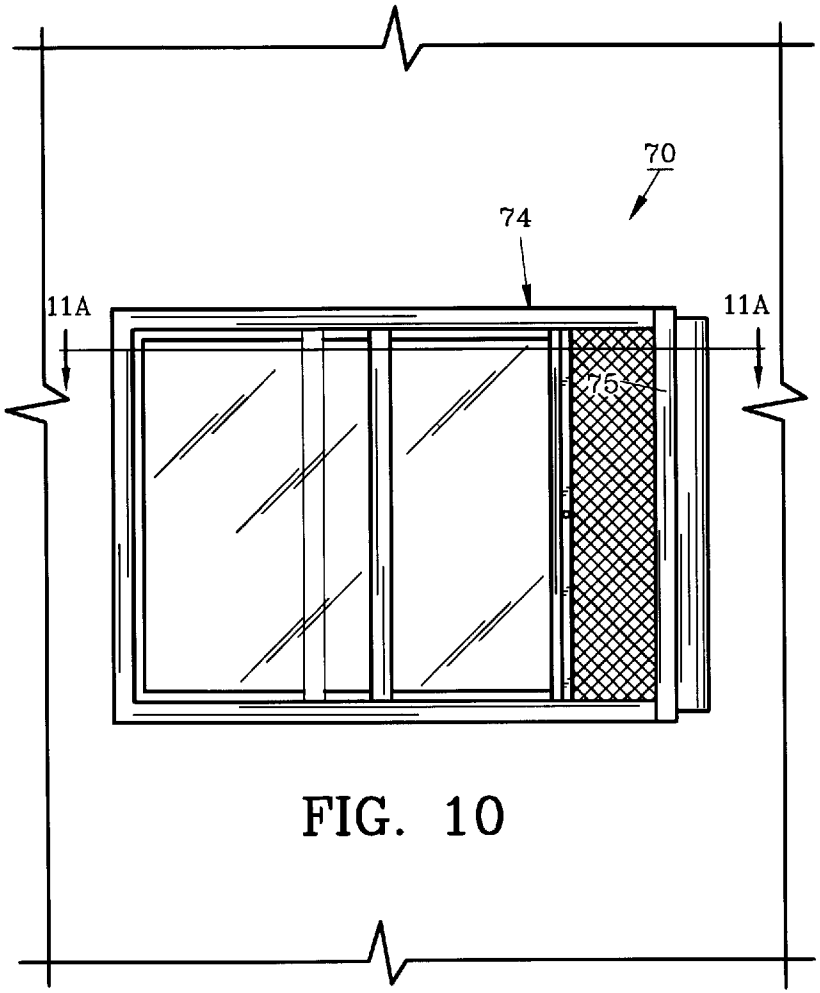
FIG. 10 pictures a laterally sliding window sash with the coiled screen along one side thereof.

In another window configuration, in FIG. 10, side sliding window 70 is shown. Here, screen coil 71 is contained within vertical apron 73 and allows screen 78 to operate by attachment to rigid pivot bar 74 which turns around threaded member 75 as further seen in FIGS. 10A and 10B.

Figures 11A, 11B, 12A, 12B, 13:
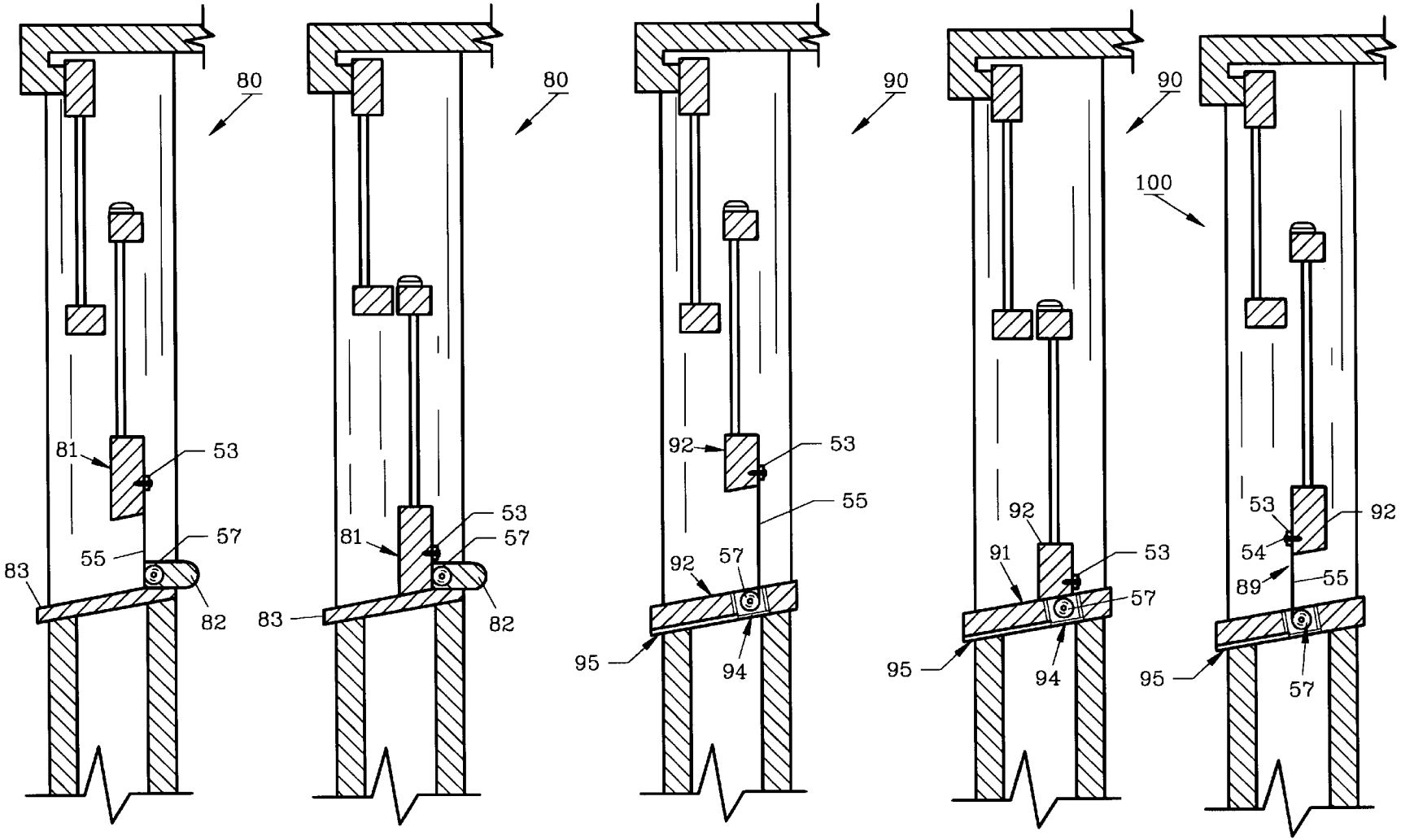
FIG. 11A shows another embodiment of the invention with the coiled screen concealed within the stool with the screen attached to the raised lower sash.
FIG. 11B depicts the window of FIG. 11A, but with the lower sash closed.
FIG. 12A demonstrates yet another embodiment of the invention with the coiled screen positioned in the window sill, with the lower sash raised.
FIG. 12B features the window of FIG. 12A, but with the lower sash closed.
FIG. 13 pictures the window of FIG. 12A, but with the coiled screen affixed to the outside or rear surface of the lower sash lateral member.

FIG. 11A illustrates another double-hung window 80 in which lower sash member 81 is shown open (raised) with screen 55 affixed thereto along the front surface by pivot bar 53 which is attached to screen 55 which in turn is joined to sash member 81. Screen 55 is unwindable from screen coil 57 contained within stool 82. As shown in FIGS. 11A and 11B, stool 82 is rigidly mounted to sill 83 and has been encavitated to contain screen coil 57 which includes a spring-loaded core to rewind easily, as earlier explained, as the lower sash is closed. The rear of stool 82 is open to allow screen 55 to unroll therefrom and conveniently attach to lateral sash member 81. U-shaped channels or the like may be utilized as described in FIGS. 7A and 7B to maintain the edges of screen 57 in place and to prevent insect entry therealong.

Still another embodiment of the invention is illustrated in FIGS. 12A and 12B in which double-hung window 90 is shown in a schematic side representation. As seen, spring-loaded screen coil 57 is positioned directly in sill 91 with screen 55 attached to lower lateral sash member 92 by pivot bar 53 as hereinbefore described. As shown, pivot bar 53 is rotatably affixed to the inside face of lower lateral sash member 92 in FIGS. 12A and 12B. To prevent rain or the like from remaining within cavity 94 created to retain screen coil 57, drain 95 is shown which may consist of a biased channel or the like extending from cavity 94 to the exterior of sill 91.

In still another embodiment, as shown in FIG. 13, sill 91 is depicted with screen 55 unwinding from screen coil 57 and screen free end 89 affixed to the rear surface of lower lateral sash member 92. As seen, pivot bar 53 is affixed with a threaded member 54 on the rear or exterior side of sash lateral member 92. Drain 95 is also shown therewith to draw any captured moisture therefrom.

The illustrations and examples provided herein are for explanatory purposes and other embodiments and designs may be utilized with the invention disclosed such as the employment of similar concealed screen coils in the top lateral member of the top sash for attachment to the upper frame, or the placement of a screen coil in the top lateral member of the bottom sash for attachment to the top sash lower lateral member, for use in place of the pivotable flap shown to prevent insect entry. Such modifications and equivalents of the embodiments herein described are not intended to limit the scope of the appended claims.

I claim:

1. A window sash and screen combination comprising:

(a) a window frame, said window sash contained within said frame, said window sash comprising an elongated lower lateral member; and (b) a screen coil, said screen coil positioned proximate said window frame, a pivotable bar, said screen coil attached to said pivotable bar, elongated means for pivotally attaching said pivotable bar to said lower lateral member, said elongated attaching means located at the approximate midpoint of the length of said lower lateral member, said elongated attaching means positioned perpendicularly to the plane of said window frame, said pivotable bar rotatable about said elongated attaching means, whereby opening said window sash will unwind said screen coil and will allow said bar to rotate around said elongated attaching means to prevent binding of said screen should said window sash yaw during movement.

2. The combination of claim 1 wherein said screen coil is spring loaded.

3. The combination of claim 1 wherein said window frame comprises a stool, said screen coil mounted proximate said stool.

4. The combination of claim 3 wherein said screen coil is positioned below said stool.

5. The combination of claim 3 wherein said screen coil is positioned above said stool.

6. The combination of claim 1 and including a rotatable screen edge channel, said rotatable channel positioned on said frame beside said sash.

7. The combination of claim 1 and including an apron, said screen coil contained within said apron.

8. The combination of claim 7 wherein said apron defines a screen passageway.

9. The combination of claim 8 and including a bracket, said bracket positioned proximate said passageway.

10. Window screen apparatus comprising: a window sash, a core, a screen wound on said core, said screen having a free end, said free end for attachment to a window sash, elongated means for pivotally attaching said screen free end to the approximate midpoint of the length of said window sash, said elongated attaching means being perpendicular to said screen free end, whereby said screen free end pivots about said elongated attaching means relative to said window sash to prevent said screen from binding should said window sash yaw during movement.

11. The window screen apparatus of claim 10 wherein said screen comprises a fiberglass screen.

12. The window screen apparatus of claim 10 wherein said screen comprises a metal screen.

13. The window screen apparatus of claim 10 wherein said screen comprises a polymeric screen.

14. The window screen apparatus of claim 10 wherein said core is spring loaded.

15. The window screen apparatus of claim 10 wherein said pivot bar is formed of metal.

16. The window screen apparatus of claim 10 and including a screen tractor drive, said tractor drive for engaging said screen.

17. The window screen apparatus of claim 10 and including a window sill, said core contained within said window sill.

18. A window screen assembly for attachment to a window sash, said window sash slidably carried by a window frame and having an elongated lower lateral member, said assembly comprising:

(a) a screen coil, said screen coil positioned proximate said window frame, said screen coil comprising a screen, said screen comprising a free end;

(b) a pivot bar, said pivot bar rigidly attached to said screen free end; and (c) elongated means for pivotally attaching said pivot bar to the approximate midpoint of the lower lateral member, said elongated attaching means being perpendicular to said pivot bar, whereby said free end is pivotable relative to said lower window sash to prevent said screen from binding should said lower window sash yaw during slidable movement within said window frame.

19. A window sash and screen combination comprising:

(a) a window frame, said window sash movably contained within said frame, said window sash comprising an elongated lower lateral member; and (b) a screen coil, said screen coil mounted proximate said window frame, the free end of said screen coil pivotally attached to said lower lateral member to allow said screen coil to uncoil and coil relative to the movement of said window sash, said screen coil free end attached to the midpoint of said lower lateral member along the length thereof, whereby moving said window sash within said frame will allow said screen coil free end to pivot parallel to said lower lateral member to prevent binding of said screen should said window sash yaw during movement.

20. The combination of claim 19, further comprising an elongated member pivotally joining said screen coil free end to said lower lateral member.

21. The combination of claim 20, wherein said elongated member is perpendicular to the plane of said screen coil free end.

* * * * *